US009079426B2

(12) United States Patent
Helterline et al.

(10) Patent No.: US 9,079,426 B2
(45) **Date of Patent: *Jul. 14, 2015**

(54) DUPLEXING WEB PRESS WITH DRYING TIME CONTROL

(75) Inventors: Brian L. Helterline, Corvallis, OR (US); Mike M. Morrow, Corvallis, OR (US); Karsten N. Wilson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 70 days.

This patent is subject to a terminal disclaimer.

(21) Appl. No.: 13/704,884

(22) PCT Filed: Jun. 24, 2010

(86) PCT No.: PCT/US2010/039845

§ 371 (c)(1),
(2), (4) Date: Dec. 17, 2012

(87) PCT Pub. No.: WO2011/162762

PCT Pub. Date: Dec. 29, 2011

(65) Prior Publication Data

US 2013/0114987 A1 May 9, 2013

(51) Int. Cl.

| | |
|---|---|
| ***B41J 15/16*** | (2006.01) |
| ***B41J 3/54*** | (2006.01) |
| ***B41J 3/60*** | (2006.01) |
| ***B41J 11/00*** | (2006.01) |

(52) U.S. Cl.

CPC ..... *B41J 11/0015* (2013.01); *B41J 3/543* (2013.01); *B41J 3/60* (2013.01); *B41J 15/165* (2013.01)

(58) Field of Classification Search

CPC ..... B41J 3/60

USPC ..... 400/149, 188, 613, 614; 347/104

See application file for complete search history.

(56) References Cited

U.S. PATENT DOCUMENTS

| | | | | |
|---|---|---|---|---|
| 5,764,263 | A * | 6/1998 | Lin | 347/101 |
| 6,457,709 | B1 | 10/2002 | Madsen et al. | |
| 6,466,761 | B1 | 10/2002 | Rene et al. | |
| 6,676,313 | B1 | 1/2004 | Kelley et al. | |
| 6,916,132 | B2 * | 7/2005 | Otsuka et al. | 400/621 |
| 7,017,485 | B2 | 3/2006 | Albert et al. | |

(Continued)

FOREIGN PATENT DOCUMENTS

| | | |
|---|---|---|
| JP | 2007062858 | 3/2007 |
| WO | 02068900 | 9/2002 |

OTHER PUBLICATIONS

Kang e al., Stability Analysis for Design Parameters of a Roll to Roll Printing Machine, International Conference on Control, Automation and Systems, 2007, pp. 1460-1465.

*Primary Examiner* — Daniel J Colilla

(57) ABSTRACT

A web press includes a web travel path for a continuous media web between a first nip and a second nip. The web travel path includes a first portion in which the web moves in a first direction and which includes a first printer configured to print on a first side of the web. The web travel path also includes a second portion in which the web moves in a second direction, with second portion including a second printer configured to print on a second side of the web. The web travel path is configured to control a drying time via the respective first and second portions being in a generally parallel, vertically stacked relationship and with each respective first and second portion extending in a generally horizontal orientation.

11 Claims, 6 Drawing Sheets

(56) References Cited

U.S. PATENT DOCUMENTS

| | | | | |
|---|---|---|---|---|
| 7,165,902 | B2 | 1/2007 | Ejiri et al. | |
| 7,456,599 | B2 | 11/2008 | Piefer et al. | |
| 7,512,377 | B2 | 3/2009 | Choi et al. | |
| 7,537,301 | B2 | 5/2009 | Silverbrook | |
| 7,702,414 | B2 | 4/2010 | Okura et al. | |
| 2002/0105571 | A1* | 8/2002 | Izawa et al. | 347/104 |
| 2003/0057639 | A1 | 3/2003 | Chapman et al. | |
| 2008/0148981 | A1 | 6/2008 | Brandenburg et al. | |
| 2008/0218576 | A1 | 9/2008 | Phillips et al. | |
| 2008/0260445 | A1 | 10/2008 | Costanza et al. | |
| 2008/0264995 | A1 | 10/2008 | Henn et al. | |
| 2009/0007744 | A1 | 1/2009 | Maddalon | |
| 2009/0027449 | A1* | 1/2009 | Silva et al. | 347/47 |
| 2009/0166944 | A1 | 7/2009 | Bahrami et al. | |
| 2009/0185234 | A1 | 7/2009 | Schutte, III | |
| 2009/0189929 | A1 | 7/2009 | Motojima et al. | |
| 2009/0193989 | A1 | 8/2009 | Senoo | |
| 2009/0295872 | A1 | 12/2009 | Ray et al. | |
| 2010/0095861 | A1 | 4/2010 | Maschler | |
| 2010/0201774 | A1* | 8/2010 | Motojima | 347/104 |
| 2011/0199414 | A1* | 8/2011 | Lang | 347/16 |

* cited by examiner

DUPLEXING WEB PRESS WITH DRYING TIME CONTROL

CROSS-REFERENCE TO RELATED APPLICATION

This Utility Patent Application is a U.S. National Stage filing under 35 U.S.C. §371 of PCT/US10/039845, filed Jun. 24, 2010, published Dec. 29, 2011 as WO 2011/162762 incorporated by reference herein.

BACKGROUND

A web press enables printing a high volume of materials via use of a continuous web of media from which sheets are cut after printing desired content on the web. Typical web presses determine when and where to print by using vision systems and alignment marks on the media web. For example, a sensor is used to sense position marks or top-of-form indicators on the web of media to trigger printing at a desired location. In another example, a typical web press uses active steering mechanisms to guide travel of the media web and typically uses heaters to dry printed portions of the media web. Despite the common acceptance of typical web presses, challenges remain to achieve high quality printing in smaller formats.

DETAILED DESCRIPTION

Figure 1:
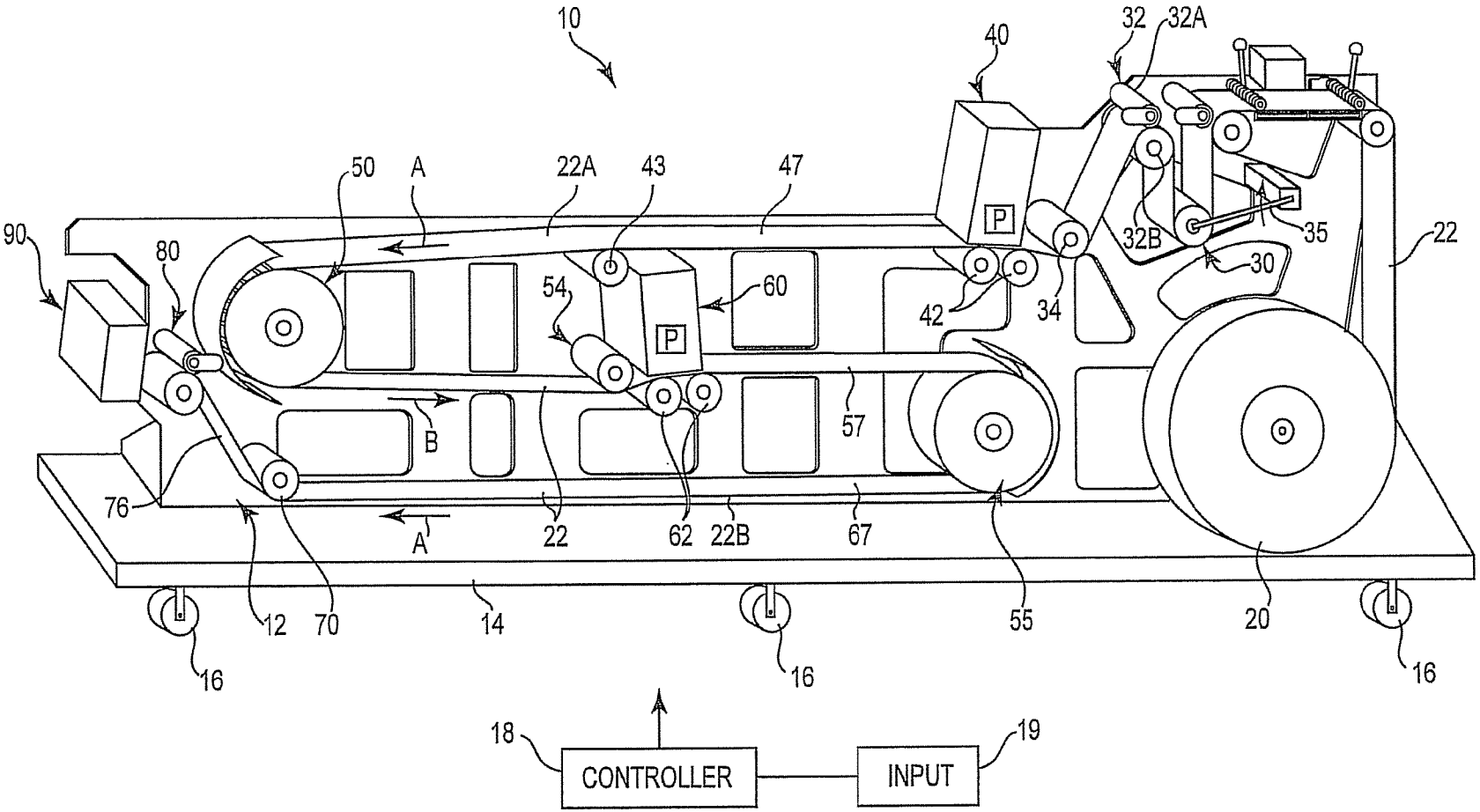
FIG. 1 is a perspective view schematically illustrating a web press, according to an embodiment of the present disclosure.

In the following detailed description, reference is made to the accompanying drawings which form a part hereof, and in which is shown by way of illustration specific embodiments in which the present disclosure may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Embodiments of the present disclosure are directed to a web press and a method of printing. In particular, some embodiments of the present disclosure provide high quality duplex printing for a web press by controlling velocity while maintaining the media web in alignment under tension without heating and without duplicative drive systems. Timing of printing is controlled without the use of alignment marks or features on the media web. Moreover, some of these embodiments are employed in a generally horizontal configuration that is modifiable to different sizes without substantially altering vertical dimensions of the web press.

In one embodiment, duplex printing is achieved with a first printer for printing on a first side of a media web and a second printer downstream from the first printer for printing on a second opposite side of the media web. In one aspect, both printers are interposed between a pair of nips to control the media web to travel at a substantially constant velocity in the printing zone between the nips.

In some embodiments, printing on a media web at both a first printer and a second printer is initiated at a top-of-form location based on a cutting frequency that occurs downstream from the printing location. This arrangement ensures top-to-bottom alignment as well as front-to-back alignment in duplex printing because the printing is synchronized according to the timing used to cut sheets. In one embodiment, the timing is based on sensing a mechanical position of the cutter In some embodiments, controlling a dry time or throughput rate of the web press is controllable via arranging several spans of the media web along its travel path into a vertically stacked, generally parallel relationship and a generally horizontal orientation. With this generally horizontal orientation, the drying time or throughput rate is achieved for a given type of media and/or ink by initially setting a combined length and/or individual length of the various spans of the web pathway that extend horizontally. It will be understood that in other embodiments, the web press is arranged so that the stack of generally parallel spans of the media web extends in a generally vertical orientation instead of a generally horizontal orientation. In this latter arrangement, in one embodiment, drying time or throughput rate is modified by changing a length of the respective spans of media web in the generally vertical orientation without substantially altering the horizontal dimensions of the web press.

In one embodiment, alignment of the media web in the web press is primarily achieved via constantly maintaining some tension on the media web from the media supply, through a buffer zone, and through the region of printing. Accordingly, once the media supply is properly aligned, maintaining this tension generally keeps the media web in proper alignment. In this arrangement, the buffer zone is located and configured to absorb variances in velocity of the media web so that the media web is fed at a substantially constant velocity to the printers of the web press and so that some constant tension is maintained on media web throughout its pathway through the web press.

These embodiments, and additional embodiments, are described and illustrated in association with FIGS. 1-10.

FIG. 1 is a perspective view schematically illustrating a web press 10, according to an embodiment of the present disclosure. As shown in FIG. 1, web press 10 includes a frame 12 supporting the various elements of web press 10. In some embodiments, frame 12 is mounted on a platform 14 with wheels 16 or otherwise configured to be mobile to permit on-demand positioning of the web press 10 without disassembling portions of web press 10. In other embodiments, frame 12 is configured to be stationary. Frame 12 can include a variety of shapes and is arranged to support a plurality of rollers, drive mechanisms and printers, as described further below.

As further shown in FIG. 1, in one embodiment web press 10 includes a controller 18, input 19, media supply 20 containing a media web 22, a dancer roller 30, a first nip 32, a first printer 40, a first directional roller 50, a second printer 60, a second directional roller 55, a second nip 80, and a cutter 90.

Media supply 20 provides a supply of media web 22 for printing and includes a magnetic clutch to control feeding of media web 22 to downstream portions of web press 20. In general terms, web press 10 can be constructed to accommodate varying widths of media web 22. In one embodiment, media supply 20 supplies a media web having a width of about 8½ inches. Moreover, in one embodiment, web 22 comprises a web of printing material such as a cellulose-based media. In another embodiment, web 22 is formed of a polymeric material. In yet another embodiment, web 22 comprises one or more other materials. In one embodiment, the printing material comprises a fluid such as one or more inks. In yet other embodiments, the printing material may comprise other types of fluid.

Before being fed to printers 40, 60, media web 22 is engaged by dancer roller 30. In one embodiment, dancer roller 30 is supported via a swing arm 35 and includes a mass, as familiar to those skilled in the art, such that dancer roller 30 is capable of moving up and down via pivoting action (represented by arrow) of swing arm 35 in response to variations in velocity of media web 22. For example, when a web velocity decreases, the dancer roller 30 drops vertically and when a web velocity increases, the dancer roller 30 rises vertically. With an appropriately selected mass of dancer roller 30, this arrangement and behavior ensures that a desired level of tension is maintained on media web 22 while absorbing any variances in velocity of media web 22 as media supply 20 feeds web 22 to printers 40, 60. In one aspect, this arrangement facilitates travel of media web 22 at a substantially constant velocity, under tension, at printers 40, 60 as well as facilitating alignment of media web 22.

As further shown in FIG. 1, the first nip 32 follows dancer roller 30 along the web pathway and corresponds to the beginning of a velocity control zone in which printing is performed between nip 32 and nip 80. In one embodiment, nip 32 includes at least a pair of rollers 32A, 32B defining a nip through which the media web 22 passes, with one of the respective rollers comprising a drive roller mechanism to cause motion of the media web along the travel path. Nip 80 includes substantially the same features and attributes as nip 32, except being located downstream from printers 40, 60 as shown in FIG. 1. In one embodiment, the post-printing nip 80 is driven at a slightly faster rate than the pre-printing nip 32 to exert and maintain a tension on media web 22 as it travels between the respective nips 32, 80, as will be described later in more detail.

From first nip 32, web 22 travels underneath positioning roller 34 and then underneath first printer 40. Rollers 42 are positioned on an opposite side of media web 22 from first printer 40 to support media web 22 during application of ink by second printer 40 to media web 22. Printer 40 selectively deposits printing material upon web 22 to form an image, pattern, layout or arrangement of printing material upon web 22. Moreover, first printer 40 includes the capability of printing in color and/or black. In some embodiments, first printer 40 is configured as a page-wide printhead array to enable printing across a full width of media web 22 without translating the individual printheads relative to the media web 22.

Second printer 60 comprises substantially the same features and attributes as first printer 40, as previously described, with rollers 62 positioned on an opposite side of media web 22 from second printer 60 to support media web 22 during application of ink by second printer 60 to the media web 22.

In some embodiments, printers 40, 60 include an array of pens (represented as P in FIG. 1). In one aspect, these pens comprise mechanisms configured to eject fluid onto web 22, and in one particular example, the pens of each printer (40, 60) include one or more print heads. In some embodiments, the print heads of printer 40, 60 each comprise thermal resistive drop-on-demand inkjet print heads. In yet other embodiments, the printheads of printer 40, 60 comprise piezo-resistive inkjet print heads. In still other embodiments, the printheads of printer 40, 60 comprise other mechanisms configured to eject fluid in a controlled manner.

According to one embodiment, the pens of printers 40, 60 include a self-contained reservoir of fluid which is supplied to the associated print heads. In yet another embodiment, the pens of printers 40, 60 each include a reservoir which is further supplied with fluid or ink via an off-axis ink supply system using one or more pumps or other mechanisms to supply a fluid to each of pens. In one embodiment, the pens of print module 22 are configured to apply multiple colors of ink such as black (K), cyan (C), magenta (M), or yellow (Y) colored inks, as well as other colors as desired.

Looking downstream from first printer 40, media web 22 travels over roller 43 to support a span 47 of media web 22 from first printer 40 to first directional roller 50. First directional roller 50 is positioned and sized to cause media web 22 to change from the first direction (A) to the second opposite direction (B) while simultaneously orienting second side 22B of media web 22 to receive printing from second printer 60. In this way, first directional roller 50 facilitates duplex printing on media web 22. In addition, by providing the directional change via a single, relative large roller 50, web press 10 creates space to house second printer 60 vertically below the first span 47 of media web 22 (and generally below first printer 40) and above second side 22B of media web 22 through the second span 57 of media web 22. In one embodiment, roller 50 includes a diameter that is generally equal to or greater than a height of second printer 60 that extends above media web 22. In another aspect, providing the directional change via a single, relatively large roller also minimizes velocity variations (typically associated with the conventional uses of many smaller rollers) due to the potential roundness variability from roller to roller.

In one embodiment, span 57 extends from first directional roller 50 to second directional roller 55, which has substantially the same features as roller 50 except for its general location. Approximately midway between the first and second rollers 50, 55 the second printer 60 applies material to media web 22. After printing, media web 22 changes direction again via second directional roller 55 so that in third span 67, the media web 22 again travels in the first direction (arrow A). In one aspect, span 67 of media web 22 extends from second directional roller 55 to roller 70, and then a short span 77 extends generally vertically from roller 70 to second nip 80. Following release from second nip 80, media web 22 enters cutter 90.

Accordingly, within the zone between first nip 32 and second nip 80, web press 10 maintains media web 22 in a web travel path under tension and moving at a substantially constant velocity as the media web 22 passes underneath first printer 40 and second printer 60. While the tension is allowed to vary within an operating range (as described later in association with FIG. 6), velocity is controlled more carefully to remain substantially constant and acts to control the position of media sheet 22 during printing between nips 32, 80. As previously noted and as further shown in FIG. 2, because first directional roller 50 changes a direction of travel of media web 22 by 180 degrees from a first direction (A) to a second opposite direction before media web 22 travels underneath second printer 60, a second side 22B of media web 22 faces the second printer 60. With this arrangement, web press 10 provides duplex printing (i.e. printing on both sides) on media web 22 within a single velocity control zone defined between a pre-printing nip 32 and a post-printing nip 80.

Figure 2:
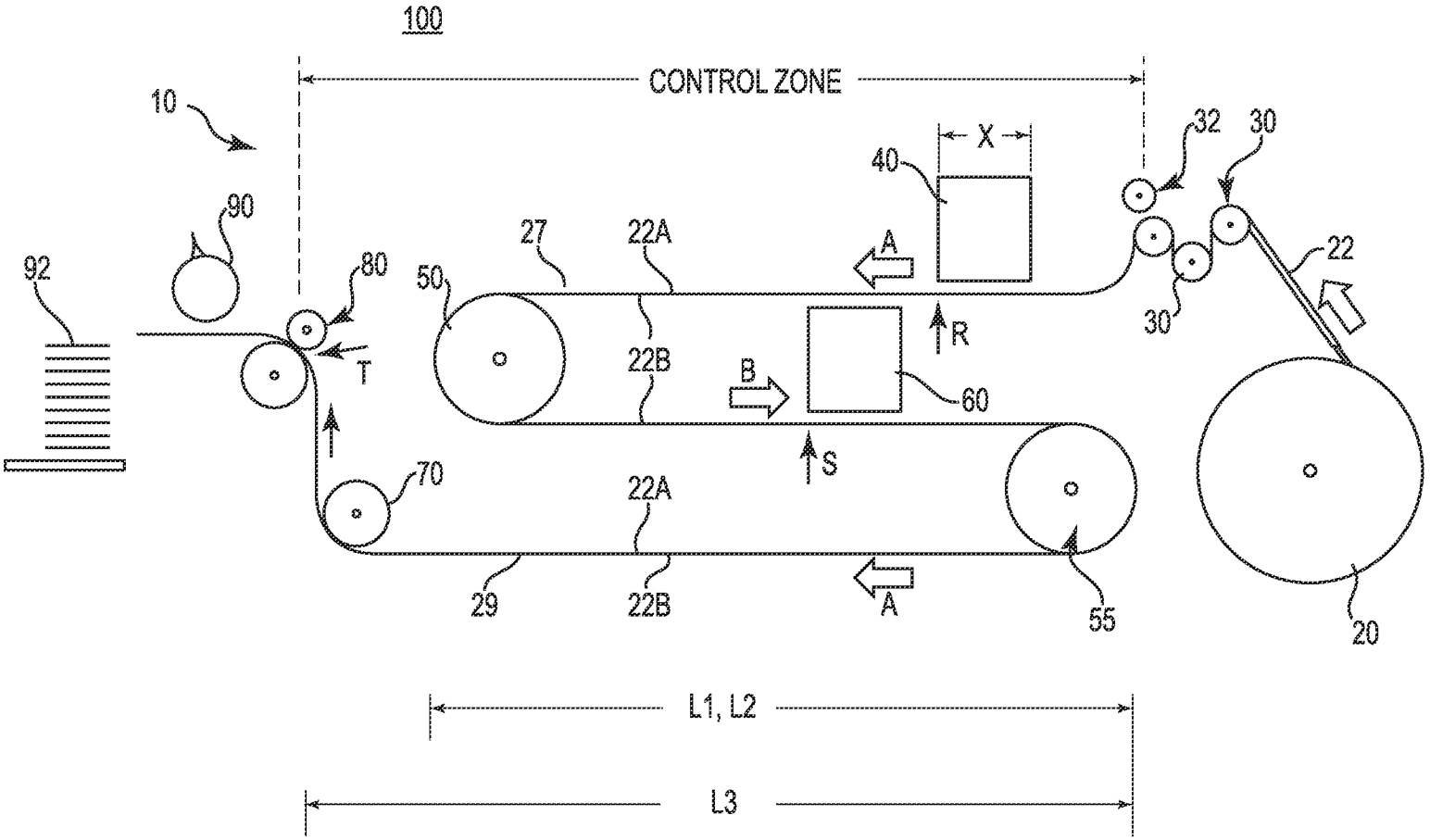
FIG. 2 is a diagram schematically illustrating a web press, according to an embodiment of the present disclosure.

With further reference to the diagram 100 of FIG. 2, it will be noted that span 27 of media web 22 from first printer 40 to second printer 60 (marked by the segment of media web 22 from arrow R to arrow S) is sufficiently long that printed matter on first side 22A of media web 22 can dry properly without heating. In other words, this span is from free from heaters, and as such comprises a first heater-free zone 27. Moreover, in one embodiment, this span 27 also omits any nips or drive mechanisms. In one aspect, printers 40, 60 have a path length (represented by X) that is substantially less than the length of span 27, with the span length being at least an order of magnitude greater than the path length (X) of printer 40 or printer 60. It follows, therefore, that the distance between nips 32 and 80 is also at least an order or two of magnitude greater than the path length (X) of printer 40 or printer 60. Accordingly, by providing a neutral zone between the first printer 40 and the second printer 60 that is substantially larger than the path length (X) of printer, material printed upon media web 22 is allowed to dry without the use of heaters.

Similarly, the span 29 (represented between arrows S and T along the web travel path) between second printer 60 and second nip 80 is sufficiently long to ensure proper drying time of printed-upon second side 22B of media web 22, such that span 29 is also heater-free. In one aspect, span 29 has substantially similar dimensional parameters as the first span 27 in that the length of span 29 is substantially longer than the path length (X) of printer 60. In some embodiments, as illustrated in FIGS. 1-2, length of second span 29 is longer than first span 27 to ensure further drying before the printed media web 22 is cut at cutter 90. In another aspect, in some embodiments the second printer 60 is positioned about one-half a distance of web travel between the pre-printing nip 32 and the post-printing nip 80.

As previously described in association with FIGS. 1-2, web press 10 is arranged to maintain a substantially constant velocity on media web 22 as web 22 is printed upon by printers 40, 60 between nips 32, 80. In one aspect, this substantially constant velocity is achieved via minimizing the number of angular change events (e.g. turns) made by the media web 22 and/or minimizing the total degree of angular change experienced by media web 22 between nips 32,80. In one embodiment, web press 10 limits a total number of angular change events between the pre-printing nip 32 and post-printing nip 80 to less than five angular change events. For example, as shown in FIG. 1, one angular change event occurs at each of the positioning roller 34, first directional roller 50, second directional roller 55, and positioning roller 70. In other embodiments, the number of angular change events can be greater or less than five although the fewer of number of angular change events is expected to yield better velocity control. In another aspect, as shown in FIGS. 1-2, the total angular change from the pre-printing nip 32 to the post-printing nip 80 is less than about 450 degrees. In other embodiments, the total angular change (between nips 32 and 80) can be greater or less than 450 degrees although lower amounts of total angular change is expected to yield better velocity control. Accordingly, with media web 22 making as few as turns as possible and with minimizing the amount of contact with rollers, a more uniform and consistent velocity is achieved between nips 32, 80, which in turn, produces higher quality printing.

As further shown in FIGS. 1-2, cutter 90 is positioned after the second nip 80 and cuts media web 22 into separate sheets 92, which may be stacked or otherwise handled. Accordingly, the cutter 90 is located outside the velocity control zone between nips 32, 80 because it is downstream (along the web travel path) from the post-printing nip 80. In some instances, such a cutter 90 referred to as a sheeter. In some embodiments, cutter 90 includes the detailed features and attributes described later in association with FIGS. 3-5.

In general terms, web press 10 provides a web travel path in which a substantial majority of a length of the media web 22 extends in a generally horizontal orientation, and the various spans or segments of media web 22 extend generally parallel to each other. With this general arrangement, one can readily implement multiple designs by modifying a length of spans 47, 57, and 67. In one aspect, selecting the length of the various spans 47, 57, 67 or a combined length of spans 47, 57, 67 is based on at least one of a media type, an ink type, and a travel speed of the media web.

In one embodiment, at the time of initial assembly, one selects an overall path length and length of spans 47, 57, 67 (from among a plurality of possible lengths) to achieve a desired drying time between the first printer 40 and second printer 60 or between second printer 60 and second nip 80. These modifications affecting the length of generally horizontal dimensions of the spans 47, 57, 67 are made without substantially altering the vertical dimensions of the web press in general, and of the vertical stack of spans 47, 57, and 67 in particular.

In one embodiment, in order to modify the overall path length, which includes the path lengths of spans 47, 57, 67, a distance between nips 32, 80 is changed to a desired length while maintaining a substantial majority of the media web 22 between nips 32, 80 in the generally horizontal orientation. In one embodiment, this substantially majority comprises about 90 percent of the path length of media web 22 between nips 32, 80. In another aspect, the generally horizontal orientation of the respective spans is expressed by the combined length of the respective spans 47, 57, 67 (L1+L2+L3) being substantially greater than a vertical height (H in FIG. 2) of the vertically stacked arrangement of the spans 47, 57, 67. In one embodiment, the combined length of the respective spans 47, 57, 67 (L1+L2+L3) is about 2 to 3 times greater than a vertical height (H in FIG. 2) of the vertically stacked arrangement of the spans 47, 57, 67.

Accordingly, web press 10 achieves high quality duplex printing in an efficient manner with an arrangement that is scalable to accommodate different lengths of media web 22 between nips 32, 80.

In general terms, the controller 18 is configured to cause a selected throughput rate or displacement rate of the media web 22 between the pre-printing nip 32 and the post-printing nip 80. In general terms, input 19 comprises one or more mechanisms by which instructions or commands may be provided to controller 18. Examples of input 19, include, but are not limited to, a keyboard, a keypad, a touchpad, a touch screen, a microphone with speech recognition software, one or more buttons, switches and the like. Although input 19 is illustrated as being directly located with web press 10, input 19 may be an external source of commands which transmits control signals via the internet, a network or other wired or wireless communication medium.

Controller 18 comprises one or more processing units and associated memories configured to generate control signals directing the operation of web press 10. In particular, in response to or based upon commands received via input 19 or instructions contained in the memory of controller 18, the controller 18 generates signals to control operations of web press 10. Some non-limiting examples includes the controller 18 generating control signals directing operation of nips 32, 80 to drive transport of web 22, control signals directing the application or deposition of printing material by printers 40, 60, and control signals directing supply 20, nip 32, and nip 80 to control the tension of web 22 and/or the rate or velocity at which web 22 moves through web press 10.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 18 may be embodied as part of one or more application-specific integrated circuits (ASICs). Unless otherwise specifically noted, the controller is not limited to any specific combination of hardware circuitry and software, nor limited to any particular source for the instructions executed by the processing unit.

Figure 3:
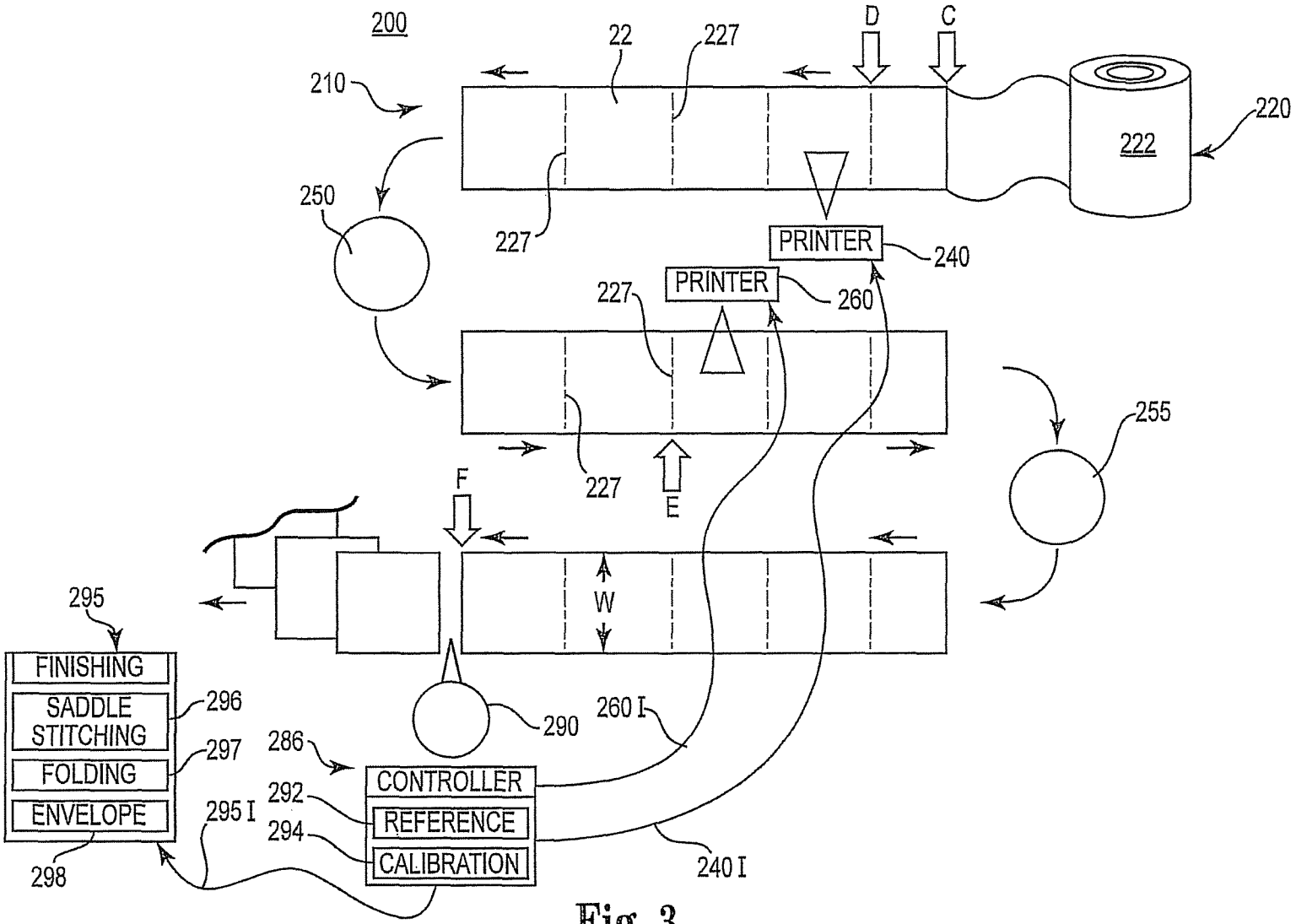
FIG. 3 is a diagram schematically illustrating a web press, according to an embodiment of the present disclosure.

FIG. 3 is a diagram 200 schematic illustrating a web press 210, according to an embodiment of the present disclosure. In one embodiment, web press 210 includes substantially the same features and attributes as web press 10 previously described in association with FIGS. 1-2, and as such, like reference numerals generally refer to like elements. Accordingly, like web press 10, the web press 210 guides travel of a continuous media web 222 along a path from supply 220 for printing via printers 240, 260 on both sides of web 222 with printer 260 located downstream from printer 240. It also will be understood that in at least one embodiment, printers 240, 260 perform duplex printing by printer 240 printing on a first side (22A in FIG. 2) of media web 222 while printer 260 prints on a second opposite side (22B in FIG. 2) of media web 222. Cutter 290 is located downstream from the second printer 260 and cuts sheets from media web 222. In one aspect, cutter 290 is located downstream from a second nip (represented by arrow F) like nip 80 (FIG. 1).

In order to ensure that content is printed at the proper locations on media web 222 to achieve high quality printed sheets, web press 210 determines which locations on the media web at which printing should be initiated. In some contexts, this determination is generally referred to as identifying a top-of-form on the media web prior to printing. In particular, the printed content has to conform with top-to-bottom constraints, as well as front-to-back constraints when printing in duplex.

As further shown in FIG. 3, arrow C represents the location and action of a pre-printing nip (such as nip 32 in FIGS. 1-2) while arrow D corresponds to a present location of a top-of-form boundary 227 of one future sheet advancing toward printer 240. Similarly, arrow E corresponds to a present location of a top-of-form boundary 227 of a future sheet advancing toward printer 260. At this location, printing already has occurred on a first side of media web 222 for a given future sheet, and via a periodic initiation signal (described below), printer 260 will print material on the second opposite side 22B of media web 222. This printed material on the second side 22B will be aligned top-to-bottom and front-to-back relative to material already printed on the first side 22A of media web 22.

It will be understood that the lines in FIG. 3 denoting boundary 227 are not physical marks or features visible on media web 222 but rather are provided for illustrative purposes to represent top-of-form locations on media web 222 based periodic time intervals for printing as further described below.

In one embodiment of web press 10, the determination of where to initiating printing along media web 22 for each future sheet (to be cut from media web 22) is made by using information from the cutter 290, which is located downstream from the printers 240, 260. Accordingly, with this arrangement, information from a location downstream is used to determine when to initiate an action upstream. In particular, in one embodiment cutter 290 tracks a frequency of cutting sheets from the media web 222 by detecting the position of a mechanical element associated with cutting. In some embodiments, the cutter 290 comprises a drum-type cutter, as will be described in more detail in association with FIGS. 4-5, and therefore the information that triggers printing is based on a rotational velocity of the drum or of an element associated with the drum. Regardless of the particular type of cutting mechanism employed in cutter 290, the cutting action is applied at periodic time intervals, so that given a certain speed of web travel relative to the cutter, a desired size sheet will be produced.

Web press 210 also includes a controller 286. In one embodiment, controller 286 includes at least substantially the same features and attributes as controller 18, as previously described in association with FIG. 1. With further reference to FIG. 3, controller 286 includes a reference function 292 and a calibration function 294. The reference function 292 is configured to determine and track a reference parameter by which to initiate printing on media web for both a front side and a back side of media web 222. In one embodiment, the reference parameter is the cutting frequency of cutter 290, such as periodic time intervals at which the media web 222 will be cut into sheets. Using this sensed information, the calibration function 294 of controller 286 generates a signal to calibrate or synchronize the actions of printers 240, 260 relative to cutter 290. In one aspect, calibration function 294 generates an initiation signal (240I, 240I) to periodically initiate printing on the media web 222 at the first and second printers 240, 260 such that when the printed-upon media web 222 arrives at cutter 290, there is proper front-to-back alignment, and top-to-bottom alignment of a future sheet that will be cut from media web 222.

As previously noted, the diagram 200 in FIG. 3 schematically illustrates virtual designations 227 on media web 222 that correspond to the respective boundary between adjacent sheets to be cut from media web 222. The virtual designations are not visible marks on media web 222 but rather indicate the tracking of the boundaries of future sheets to be cut when information from the cutter 290 is used to determine when to initiate printing at printer 240, 260.

It will be understood that in other embodiments, the reference function 292 may track a different reference parameter (other than cutting frequency) of cutter 290 or even track a reference parameter for another device along web travel path that is indicative of a throughput rate which can trigger initiation of printing without use of a vision system and/or alignment marks on the media web.

Prior to operation of web press 210, the initiation signal 2401, 2601 for printers 240, 260 is synchronized or calibrated relative to the rotational behavior of cutter 290. In particular, the initiation signal is based on several parameters, including but not limited to, (1) a speed of travel of web 222; (2) distance between the cutter 290 and the first printer 240, and distance between the cutter 290 and the second printer 260; (3) a desired length of the future sheets; and (4) a frequency of rotation of a drum or disc that comprises a portion of the cutter 290. In the situation where the initiation signal corresponds to a top-of-form signal, the signal also accounts for the top and bottom whitespace margins of the future sheets to be cut.

Accordingly, based on these parameters, a time interval is calculated at which printing will be periodically initiated at first printer 240 and then at second printer 260, after a fixed time delay accounting for the distance between the respective printers 260. In this way, the rotational components associated with cutter 290 effectively function as clock to cyclically initiate printing for each "future" sheet on media web. Moreover, because the rotational cutting frequency of cutter 290 is the basis for timing of printing content, the arrangement ensures that cutting locations will be matched with the top and bottom of the printed portion of web to be cut as a sheet.

Figure 5:
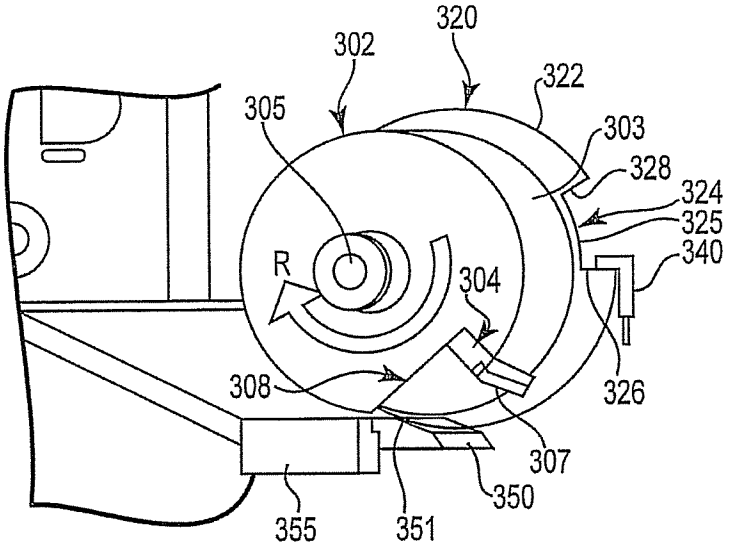
FIG. 5 is a perspective view schematically illustrating a cutter of web press in a second position, according to an embodiment of the present disclosure.
Figure 4:
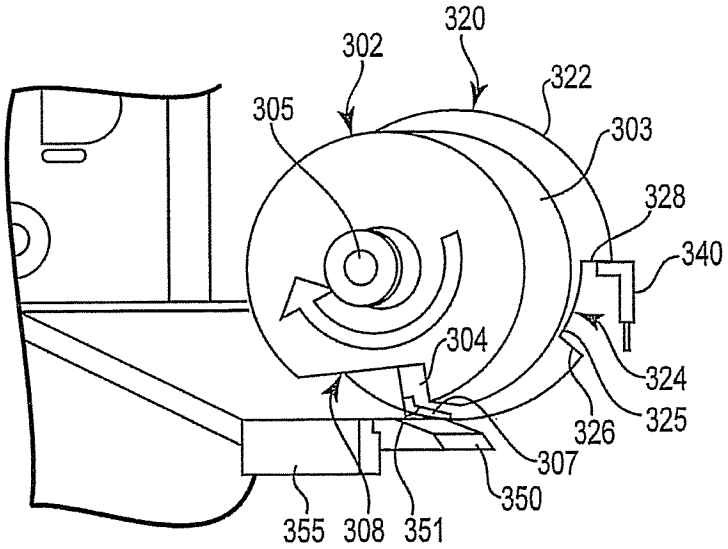
FIG. 4 is a perspective view schematically illustrating a cutter of a web press in a first position, according to an embodiment of the present disclosure.

In general terms, cutter 290 comprises a device including a cutting element 300 configured for cutting sheets from media web 222. In one embodiment, as shown in FIGS. 4-5, cutter 290 comprises a cutting element such as a generally cylindrical drum 302 on which is mounted a blade 304 with a cutting edge 307. In one aspect, the drum 302 is rotatably mounted (via an axis 305) relative to a support frame (such as frame 12) to extend transversely across a width (represented by W in FIG. 3) of the media web 222.

In one embodiment, drum 302 includes a recess portion 308 in which blade 304 is mounted such that cutting edge 307 is exposed at a surface 303 of drum 302 and in a position to engage opposing knife 351 of block 350 to result in a cutting action on media web 222 as the blade 304 moves past fixed knife 351 with each rotation of drum 302. Accordingly, the blade 304 cuts the media web 222 into separate sheets with each rotation of the drum 302.

While blade 304 extends generally transverse to the travel direction of media web 22 as shown in FIGS. 4-5, it will be understood that the cutting edge 307 of blade 304 is offset by a slight angle (e.g. 2 degrees) to create a shearing action relative to knife 351 and that in order to achieve a square cut on media web 22, the orientation of rotational axis 305 of drum 302 is adjusted appropriately to compensate for the angle offset of knife 351, as known in the art.

As shown in FIGS. 4-5, cutter 290 also includes a disc 320 and sensor 340. In one embodiment, disc 320 defines a generally circular edge 322, except for notch 324 to act as a rotational position marker. Notch 324 includes a first edge 326, floor 325, and second edge 328. In one aspect, sensor 340 is fixed relative to a frame, and therefore stationary relative to the rotatable disc 320.

With this arrangement, sensor 240 detects the various features of disc 320, including generally circular edge 322 and the respective edges 326, 328 of notch 324. In general terms, upon detection via sensor 340 of notch 324 with each rotation of disc 320 and drum 302, the controller 286 generates an initiation signal 240I, 260I to printers 240, 260 (FIG. 3) for each sensed detection of notch 324. In particular, detection of first edge 326 of notch 324 via fixed sensor 340 corresponds to a leading edge of recess 308 passing over fixed knife 351 of block 350, as shown in FIG. 5. Upon further rotation of disc 320, fixed sensor 340 detects passage of second edge 328 of notch 324 of disc 320 which corresponds to blade 304 engaging knife 351 of block 350 to cut a sheet from media web 322, as shown in FIG. 4.

As shown in FIG. 3, the initiation or calibration signal is communicated to both the first printer 240 and the second printer 260 with controller accounting for a delay of initiation from the first printer 240 to the second printer 260 to account for the distance between the respective printers. As will be apparent, controller 286 also dictates the duration of printing to place content on media web on a sheet-by-sheet format onto continuous media web 222.

With this arrangement, printing is performed at the desired location on media web 222 without detecting features or alignment marks on the media web 222, as is otherwise typically done with conventional web presses. Consequently, web press 210 operates without a costly or complex vision system to detect such marks and/or without alignment marks on a media web 222.

In some embodiments, instead of using disc 320 and notch 324 as the rotational position element to track rotational frequency of cutter 290, an encoder mechanism is used to count encoder markings on a motor of cutter 290. The encoder count is used to develop a top-of-form signal used to trigger initiation of printing on media web.

While the cutter 290 is located after second nip 280, and therefore after printing is completed, it will be understood that in some embodiments, cutter 290 forms part of a single assembly with the components that perform printing. In this aspect, cutter 290 would be integrated into the web press 220 as opposed to the cutter 290 being a separate and independent device as in conventional web presses. Moreover, with reference to earlier described embodiments (FIG. 1) in which the web press 10 was indicated to be mobile for on-demand positioning, movement of the web press 10 automatically includes transport of the cutter 90, 290. However, it will be understood that in other embodiments, cutter 90 or 290 is an independent device that is separate from the printing components of web press 10, 210, and therefore not integrated into web press 210.

In some embodiments, the signal tracked at cutter 290 is used to synchronize additional processes downstream from cutter 290 in a manner substantially similar to synchronizing initiating of printing on media web 222. For example, as shown in FIG. 3, additional processes, could include but are not limited to, operations at a finishing module 295 such as a saddle stitching function 296, a folding function 297, and/or an envelope-interaction function 298, and the like.

Figure 6:
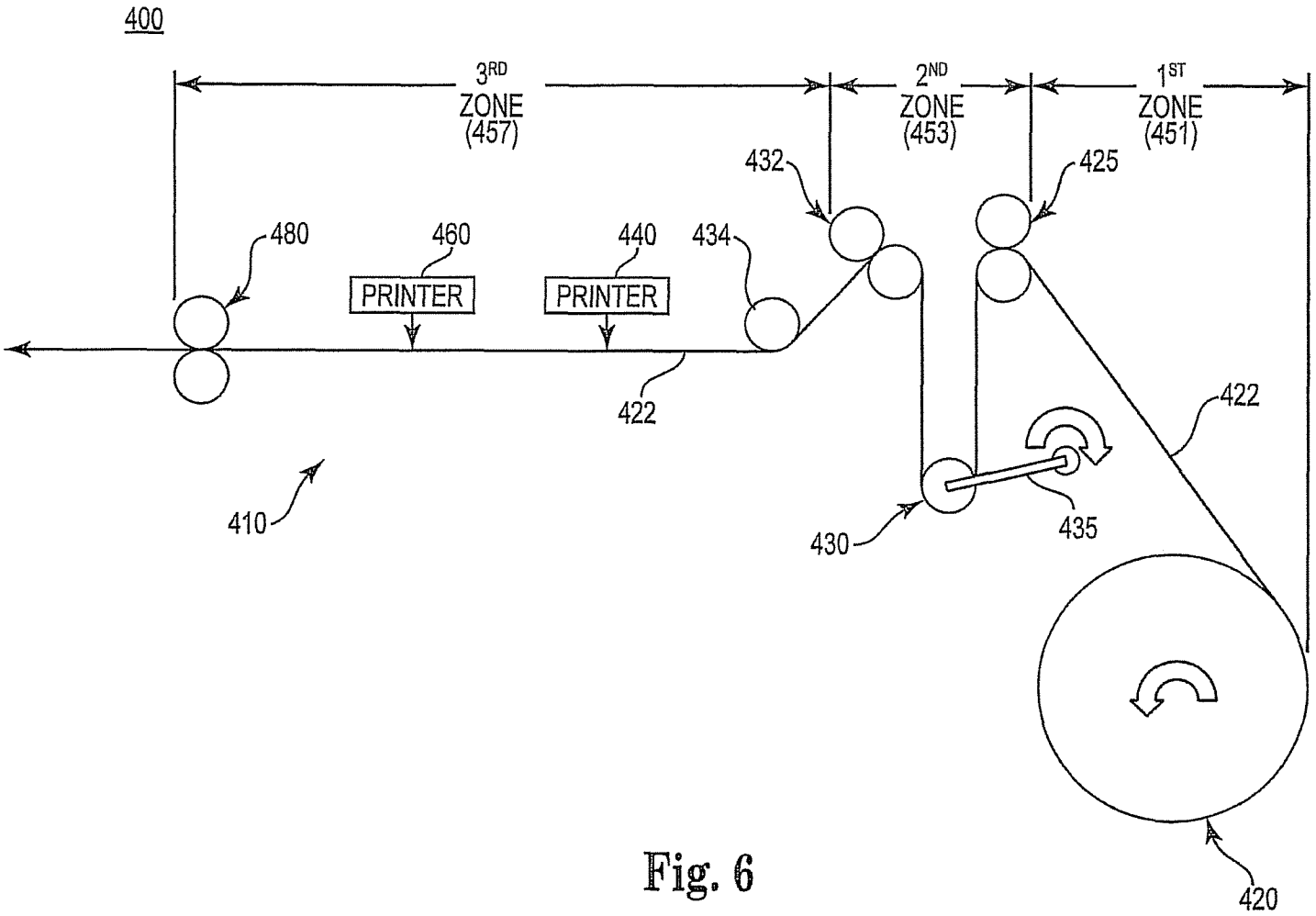
FIG. 6 is a diagram schematically illustrating a web press, according to an embodiment of the present disclosure.
Figure 8:
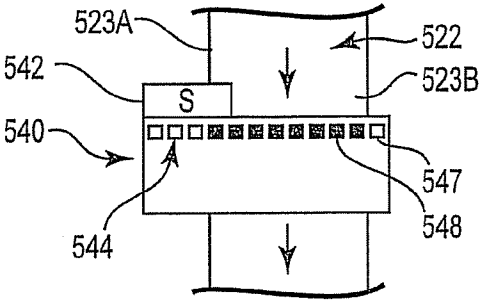
FIG. 8 is a top plan view schematically illustrating a printer portion of a web press, according to an embodiment of the present disclosure.

FIG. 6 is a diagram 400 that schematically illustrates a web press 410, according to an embodiment of the present disclosure. In one embodiment, web press 410 includes at least substantially the same features and attributes as web press 10 or 210, as previously described in association with FIGS. 1-3. As shown in FIG. 8, the web press 410 includes a media supply 420 for supplying a continuous web 422, a dancer roller 430, a first nip 432, a second nip 480, and one or more printers 460, 480. As in earlier embodiments, the term dancer roller 430 refers to arrangement in which roller 430 supports a portion of media web 422 in a spaced position away from first nip 432 and nip 425 and is supported via swing arm 425 to vary the spacing of roller 430 relative to nips 432, 425 in order to maintain a substantially constant level of tension on media web 422.

With this arrangement in mind, web press 410 includes a first web tension zone 451, a second web tension zone 453, and a third web tension zone 457. The first web tension zone 451 extends from the media supply 420 to nip 425. The second web tension zone 453 is located downstream from the first web tension zone 451, extends between nip 425 and nip 432, and is defined primarily by the dancer roller 431. The third web tension zone 457 is located downstream from the second tension zone 453 and extends between the respective first and second nips 432, 480. The printer(s) 440, 460 are located in the third web tension zone 457 and print on the media web 422 according to an alignment path determined relative to a detected edge of the media web, as will be further described in association with FIGS. 9 and 10.

In one embodiment, second tension zone acts as a buffer to effectively absorb or compensate for any variances in velocity as media web 422 is taken off media supply 420 so that media web 422 constantly remains under some amount of tension through its entire path from media supply 420 through the third tension zone 457 wherein printing occurs. In this respect, the media web 422 remains coupled within a travel path as the media web 422 transitions from media supply 420 to printing operations in third tension zone 457. Unlike a conventional web press, this arrangement maintains the media travel path under tension without decoupling the media web. In one embodiment, first tension zone 451 applies a tension of about one-half lbs/inch while second tension zone 452 maintains a tension of about one-half lbs/inch. However, the second tension zone 452 maintains this tension by the dancer roller 430 supported by swing arm 425 (and associated mass). The third tension zone 457, in which printing operations take place, constantly maintains tension on media web 422 but allows the tension to vary within an operating range of one-quarter lbs/inch to one lb/inch. In one aspect, the tension in third tension zone 457 is achieved and maintained by driving nip 480 slightly faster than nip 432.

Maintaining tension through all three zones 451, 453, and 457 greatly facilitates achieving and maintaining a substantially constant velocity on media web 422 as it travels through the third tension zone 457 in which printing operations take place. By maintaining a substantially constant velocity with the web constantly under tension from the media supply 420 and through the printing operations, high quality printing is achieved without using complex control systems directly adjacent the printers.

In general terms, by maintaining the tension on media web 22 consecutively through zones 451, 453, 457, web press 410 maintains an alignment path for media web 422 relative to the printers 440, 460 and relative to various nips and rollers. In one embodiment, further alignment can occur via laterally shifting media supply 420 until the proper alignment of the media web 422 is achieved for travel in alignment with printers 440, 460, and other elements of web press 410.

In one aspect, assuming a given alignment path is maintained, the alignment path will be coordinated with a position of the printers 440, 460 to ensure proper alignment of the printers relative to media web 422.

Figure 7:
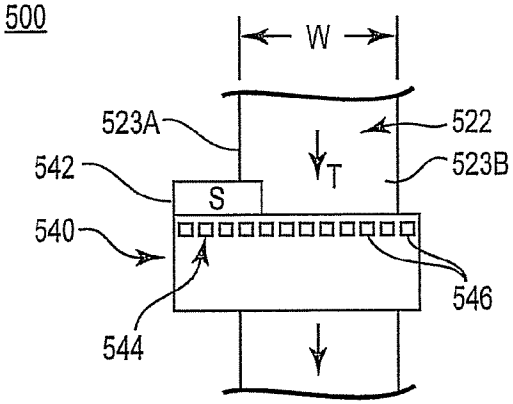
FIG. 7 is a top plan view schematically illustrating a printer portion of a web press, according to an embodiment of the present disclosure.

FIG. 7 is a diagram 500 that schematically illustrates alignment of media web 522 relative to printer 540 on a web press, such as web press 410 (FIG. 8). As shown in FIG. 7, media web 522 includes a first edge 523A and second edge 523B while printer 540 includes sensor 542 and printheads defining an array 544 of nozzles 546. In one aspect, the nozzles 546 extend generally parallel to a width (W) of the media web or generally transverse to travel direction (represented by arrow T) of media web 522. The sensor 542 is positioned to detect an edge 523A of the media web 522. In order to ensure printing that is aligned relative to the path of the media web, the detected edge is used as a reference point to select nozzles 546 from the array that will result in proper alignment while printing on the media web 522.

FIG. 8 shows an example in which sensor 542 has detected edge 523A and determined that in order for proper alignment, nozzles 548 (black) will be activated and nozzles 547 (white) of array 544 will remain dormant.

Figure 9:
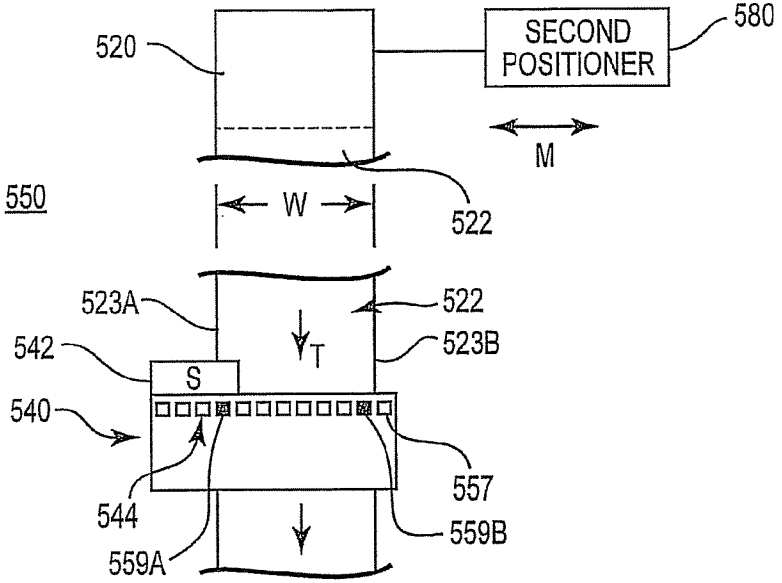
FIG. 9 is a top plan view schematically illustrating a printer portion of a web press, according to an embodiment of the present disclosure.
Figure 10:
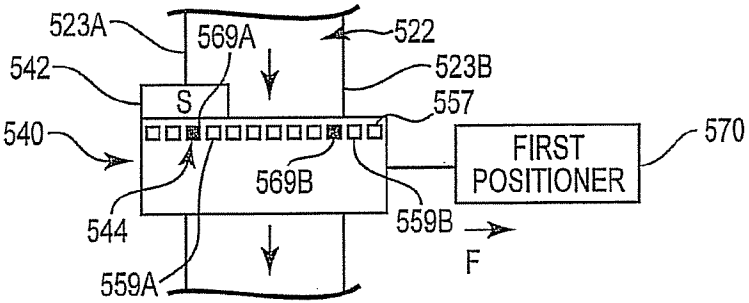
FIG. 10 is a top plan view schematically illustrating a printer portion of a web press, according to an embodiment of the present disclosure.

FIGS. 9-10 schematically illustrate another embodiment in which alignment of printer 540 occurs through another mechanism, such as shifting the entire printhead array or printer 540 instead of merely activating select nozzles. As shown in FIG. 9, nozzles 559A, 559B represent the outermost nozzles of array 544 which would still be able to print on media web 522 in its current travel path. By detecting first edge 523A via sensor 542, an adjustment is made via shifting the entire printer 540 (or the printhead array) laterally via first positioner 570 so that nozzles of array 544 become more centered relative to the path of media web 522. As shown in FIG. 10, when printer 540 is shifted laterally (represented by F) relative to media web 522 the entire array 544 becomes generally more centered. Accordingly, as illustrated in FIG. 10, a different grouping of nozzles is activated so that nozzles 569A, 569B become the outermost active nozzles for printing. In this way, while the respective tension zones 451, 453, 457 generally maintain media web 522 along a given alignment path, the use of sensor 542 allows adjustments to be made via printer 540 in the event further alignment become desired.

Embodiments of the present disclosure provide high quality duplex printing for a web press by controlling velocity while maintaining the media web in alignment under tension without heating and without duplicative drive systems. Timing of printing is controlled without the use of alignment marks or features on the media web, and therefore, the web press efficiently omits complex, costly vision systems. Moreover, these embodiments are employed in a generally horizontal configuration that is modifiable to different sizes without substantially altering vertical dimensions of the web press.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A web press comprising:

a web travel path for a continuous media web between a first single nip and a second nip, the web travel path including:

a first portion in which the web moves in a first direction and includes a first printer configured to print on a first side of the web; and a second portion in which the web moves in a second direction and includes a second printer configured to print on a second side of the web;

a first single roller interposed between the first portion and the second portion to cause a first 180 degree change in web travel from the first direction to the second direction, wherein the first single roller has a diameter equal to or greater than a height of the second printer; and a second single roller at the end of the second portion to cause a second 180 degree change in web travel from the second direction to the first direction, wherein the second roller has a diameter equal to or greater than a height of the second printer, wherein the second portion extends from the first single roller to the second single roller, and wherein the web travel path is configured to control a drying time via the respective first and second portions being in a generally parallel, vertically stacked relationship and each extending in a generally horizontal orientation.

2. The web press of claim 1, wherein the web travel path includes:

a third portion located downstream from the second portion and the second single roller, and in which the web moves in the first direction, wherein the third portion extends in a generally horizontal orientation and is also generally parallel in vertically stacked relation to the respective first and second portions.

3. The web press of claim 2, wherein the first, second and third portions are heater-free.

4. The web press of claim 1, wherein the first printer is located directly adjacent the first single nip and the second printer is located generally midway between the first single roller and the second single roller to be approximately one-half a distance between the first single nip and the second nip.

5. The web press of claim 1, wherein a combined length of the first and second portions in the generally horizontal orientation is substantially greater than a height of the vertical stack of the first and second portions.

6. The web press of claim 1, comprising:

a mobile frame on which the web travel path is mounted and configured to provide on-demand mobile positioning of the entire web press.

7. A web press comprising:

a web travel path for a continuous web of print media having an overall span extending between a first, single pre-printing nip and a post-printing nip;

a first printer on a first side of the web in a first portion of the web travel path in which the web is movable in a first direction, the first printer being directly adjacent the first, single pre-printing nip; and a second printer on a second side of the web in a second portion of the web travel path in which the web is movable in a second opposite direction;

a first single roller interposed along the web travel path between the first printer and the second printer, wherein the first roller has a diameter equal to or greater than a height of the first printer; and a second single roller between the respective second and third portions to cause a second 180 degree change in web travel path from the second direction to the first direction, wherein the second printer is located generally midway between the first single roller and the second single roller to be approximately one-half a distance between the first, single pre-printing nip and the post-printing nip, wherein the respective first and second portions extend generally parallel to each other in a vertically stacked relationship and in a generally horizontal orientation to enable implementing a scalable length of the web travel path without substantially altering a vertical dimension of the web press, and wherein a first portion of the overall span extends between the first printer and the second printer, the first portion having a path length that is at least one order of magnitude greater than a path length of the first printer.

8. The web press of claim 7, wherein the first and second portions are heater-free.

9. The web press of claim 7, comprising:

a third portion of the web travel path located downstream from the second portion and in which the web moves in the first direction, wherein the third portion extends in a generally horizontal orientation and generally parallel to the respective first and second portions with the respective first, second, and third portions being spaced apart from each other in a vertically stacked relationship.

10. The web press of claim 9, wherein a combined length of the respective first, second, and third portions is substantially greater than a vertical height of the vertically stacked arrangement of the respective first, second, and third portions.

11. The web press of claim 7, wherein the path length of each respective first and second printer is at least two orders of magnitude less than a length of the overall span.

* * * * *